United States Patent [19]

Dobler et al.

[11] Patent Number: 5,054,398

[45] Date of Patent: Oct. 8, 1991

[54] PROCESS AND APPARATUS FOR DISPERSING SUBMUNITION BODIES

[75] Inventors: Josef Dobler, Penzberg; Peter Kostelezky, Weingarten, both of Fed. Rep. of Germany

[73] Assignee: Messerschmitt-Bolkow-Blohm GmbH, Fed. Rep. of Germany

[21] Appl. No.: 533,085

[22] Filed: Apr. 9, 1990

[30] Foreign Application Priority Data

Apr. 10, 1989 [DE] Fed. Rep. of Germany ..... 3911654

[51] Int. Cl.[5] ..... F42B 10/56; F42B 12/58; B64D 17/34

[52] U.S. Cl. ..... 102/387; 102/489; 244/152

[58] Field of Search ..... 244/152; 102/387, 411, 102/489, 393, 337, 338, 339, 348, 354

[56] References Cited

U.S. PATENT DOCUMENTS

| | | | |
|---|---|---|---|
| 2,565,470 | 8/1951 | Brown | 102/387 |
| 2,868,125 | 1/1959 | Rogge | 102/387 |
| 2,920,561 | 1/1960 | Berlin et al. | 102/387 |
| 3,124,072 | 3/1964 | Herrmann | 102/348 |
| 3,348,793 | 10/1967 | Kriesel et al. | 244/152 |
| 3,362,664 | 1/1968 | McElroy | 244/152 |
| 3,388,879 | 6/1968 | Pisano et al. | 244/152 |
| 3,578,275 | 5/1971 | Kriesel et al. | 244/152 |
| 4,178,851 | 12/1979 | Brady | 102/353 |
| 4,624,427 | 11/1986 | Atzrott | 244/152 |

*Primary Examiner*—David H. Brown

*Attorney, Agent, or Firm*—Evenson, Wands, Edwards, Lenahan & McKeown

[57] ABSTRACT

A parachute pack sack with a submunition body affixed directly to grappling ropes of a parachute is expelled from a rapidly flying container which is mounted under a flight aggregate or flies independently. A pyrotechnic cutting device is actuated by a grappling rope after the tightening of the latter and, by means of a cutting piston driven by a combustion unit, cuts a pack sack closing line which results in an opening of the pack sack and in a deployment of the parachute. The combustion unit may be ignited with an adjustable start of the burning time whereby differing flying ranges and dispersion ranges of the submunition body can be achieved.

2 Claims, 3 Drawing Sheets

PROCESS AND APPARATUS FOR DISPERSING SUBMUNITION BODIES

BACKGROUND AND SUMMARY OF THE INVENTION

The invention relates to a process and apparatus for dispersing submunition bodies which are expelled from a flight aggregate or a container mounted at the flight aggregate together with a parachute pack connected to them and which, after the parachute pack has opened up and flown off, float to the ground hanging on parachutes.

A parachute pack with a submunition body of the above-noted type is known on the basis of U.S. Pat. No. 38 17 179. In that case, the submunition body is a mine which is connected by way of a connecting cord with the parachute pack comprising two shells. The mine and the parachute pack together are manually thrown out of a slow-flying flight aggregate, such as a helicopter, the parachute pack also being connected with the flight aggregate by means of holding line. When the connecting cord as well as the holding line are drawn tight, the shell parts of the parachute pack are separated from one another by means of a tear string and are supposed to fly off. The holding line which is connected with the vertex of the parachute can then pull out the parachute, after which it tears off at a predetermined breaking point and thus releases the mine with the parachute. This arrangement has several disadvantages. The manual throwing-out is possible only from a slow-flying flight aggregate. The ripping-open of the two pack sack halves cannot take place before both lines are drawn tight. During slow flying, the two pack sack shells may prevent the parachute from opening and damage it. Several flights are necessary to cover a fairly large area with mines.

It is an object of the invention to develop a process for dispersing submunition bodies of the initially mentioned type in such a manner that the parachute can be brought out without any danger also during fast flying and that the possibility exists to disperse the submunition bodies over a fairly large area in only one overflight.

This object is achieved according to the invention by providing an arrangement comprising:

- tightening of the grappling ropes of the parachutes after the expulsion,
- pulling-out of trigger pins from cutting devices arranged at pack sack closing lines by one of the grappling ropes respectively,
- activating of combustion units contained in the cutting devices with a respective given start of the burning time,
- cutting of the pack sack closing lines by cutting pistons driven by the combustion units,
- flying-off of the pack sacks and the cutting devices,
- opening of the parachutes and the floating-down of the submunitions bodies, and
- dispersing of the submunition bodies on a surface at distances depending on the start of the burning time of the combustion units for the cutting devices.

Other objects, advantages and novel features of the present invention will become apparent from the following detailed description of the invention when considered in conjunction with the accompanying drawings.

DETAILED DESCRIPTION OF THE DRAWINGS

Figure 1:
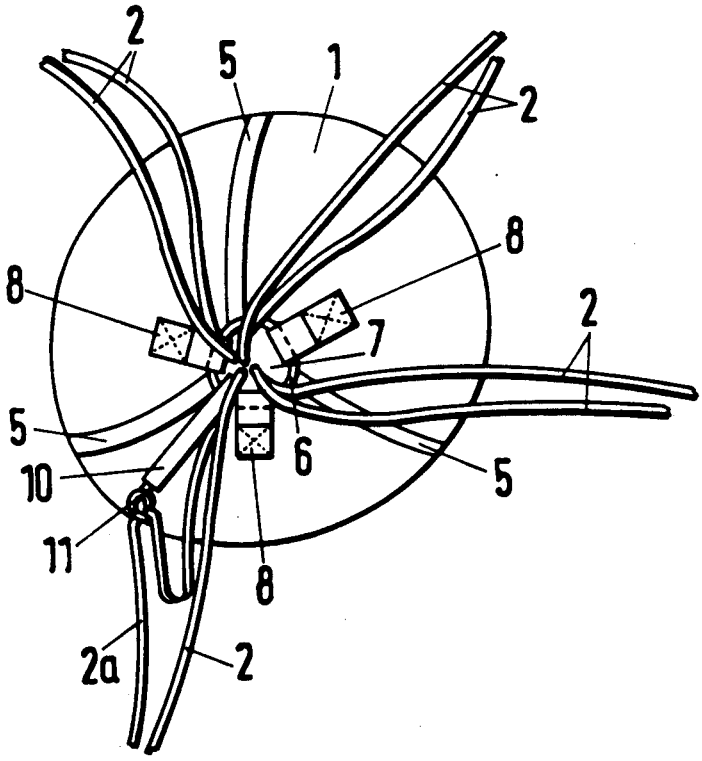
FIG. 1 is a schematic view of a parachute deployment system for submunition bodies constructed according to a preferred embodiment of the invention.
Figure 2:
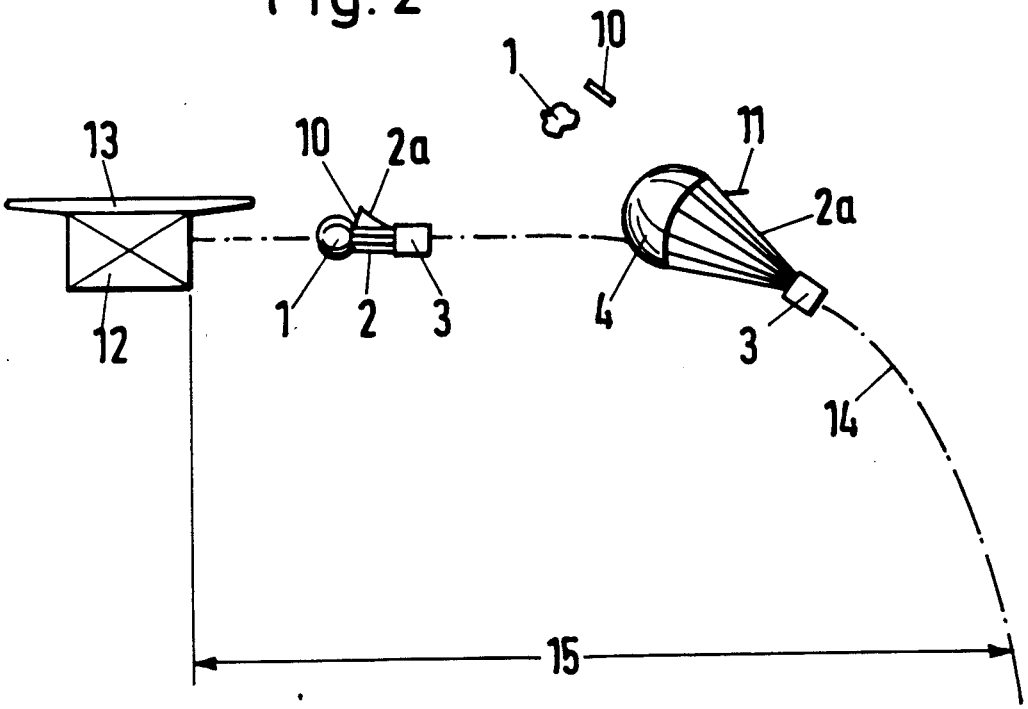
FIG. 2 is a schematic view depicting the deployment sequence for the system of FIG. 1.

Eight grappling ropes 2 which, on one side, are connected with a submunition body 3 shown only in FIG. 2 and, on the other side, are connected with a canopy 4, project out of a parachute pack sack 1 made of cloth according to FIG. 1, which parachute pack sack 1 is known per se. The parachute pack sack 1 is provided with longitudinal reinforcements 5.

Figure 2A:
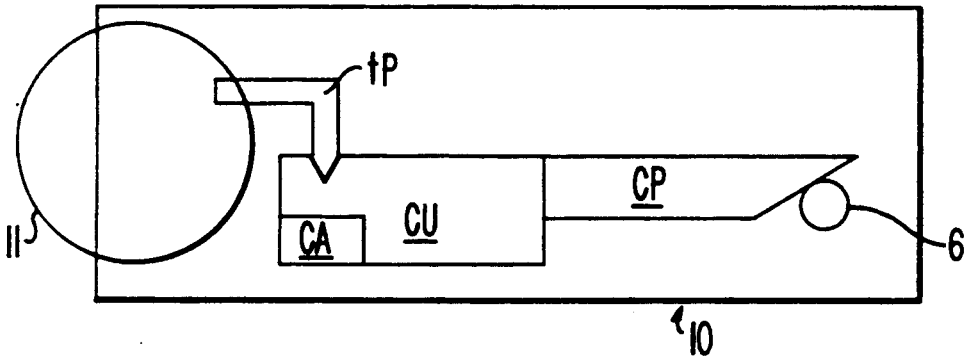
FIG. 2A is a schematic depiction of the cutting device of FIGS. 1 and 2.

A pack sack closing line 6 leaves open a small opening 7 through which the grappling ropes 2 are connected with the folded-up canopy 4. The pack sack closing line 6 extends under sewn-on reinforcements 8. A tube-shaped cutting device 10, which is known per se, is applied to the pack sack closing line 6 and, at its other end, is provided with a ring 11 through which one of the grappling ropes **2*a* is pulled and by means of which it is referring to FIG. 2A, a trigger pin TP for a combustion unit CU which is also present in the cutting device 10 is disposed at the ring 11, and projects into the cutting device 10. In a known manner, the combustion unit CU is equipped with a device CA for the adjustable starting of the burning time. The fuel gases of the combustion unit CU can displace a cutting piston CP which, when it is actuated, cuts the pack sack closing line 6** causing the pack sack to open and the parachute to deploy.

The course of the expulsion sequences shown schematically in FIG. 2 shows a submunition container 12 which, by means of a flange 13, is to be fastened under a flight aggregate which is not shown. A pack sack 1 with a submunition body 3 is expelled from the container 12, in which case, the grappling lines 2 have already tightened, and the cutting device 10 is actuated by the grappling line **2*a*. After the cutting of the pack sack closing line 6, the parachute 4 can open and the pack sack 1 and the cutting device 10 will fly off. As a result of the abrupt opening, the parachute 4 experiences a high increase of resistance which correspondingly results in a deflection of the flight path in the downward direction. The flying range or the range of dispersion 15 of the submunition body 3 can be adjusted according to the delay of the start of the burning time of the combustion unit in the cutting device 10**.

Figure 3:
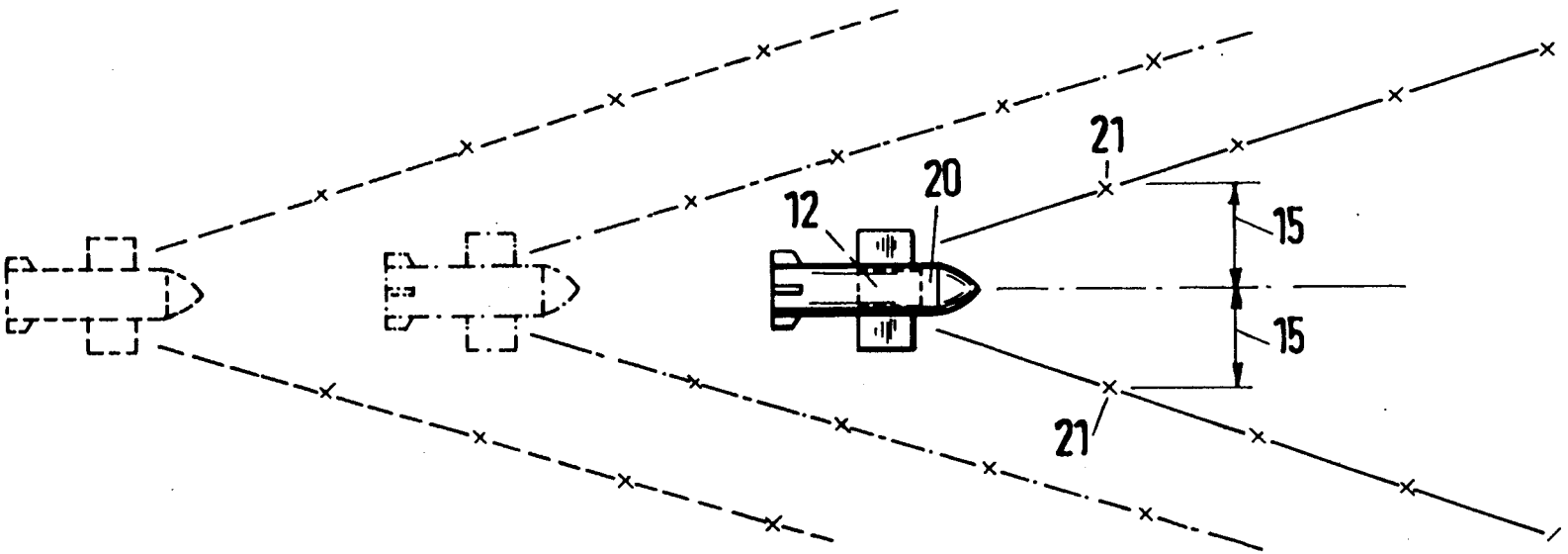
FIG. 3 is a schematic depiction of a submunition deployment pattern provided by the system of FIGS. 1 and 2.

FIG. 3 shows a flight aggregate 20 with a submunition container 12 hanging under it which is divided into three flight phases. The crosses 21 have the purpose of representing the impact points of the submunition bodies 3. As a result of the differing start of the burning time of the combustion unit for the expelling of the cutting piston at the cutting device 10, the shown ranges of dispersion 15 can be reached for the crosses 21. As shown, a fairly large area can therefore be covered with submunition bodies.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A process for dispersing submunition bodies which are expelled from a flight aggregate or a container mounted at the flight aggregate together with a parachute pack connected to them and which, after the parachute pack has opened up and flown off, float to the ground hanging on parachutes, comprising:

tightening of the grappling ropes of the parachutes after the expulsion, pulling-out of trigger pins from cutting devices arranged at pack sack closing lines by one of the grappling ropes respectively, activating of combustion units contained in the cutting devices with a respective given start of the burning time, cutting of the pack sack closing lines by cutting pistons driven by the combustion units, flying-off of the pack sacks and the cutting devices, opening of the parachutes and the floating-down of the submunition bodies, and dispersing of the submunition bodies on a surface at distances depending on the start of the burning time of the combustion units for the cutting devices.

2. Apparatus for dispensing a plurality of submunition bodies expelled from a flight aggregate together with respective parachutes connected to the submunition bodies, comprising:

means for adjustably controlling opening times for the parachutes by means of combustion units which are ignited with an adjustable start;

respective ones of said submunition bodies being connected to the parachute by grappling lines;

a pack sack being provided for holding the parachute in at least partially closed condition during a first time period after the parachute and submunition body are expelled from the flying aggregate, said grappling lines extending through opening means in said pack sack;

said means for adjustably controlling opening times including cutting means for cutting line means closing the pack sack, said cutting means being controlled by respective ones of the combustion units;

and wherein initiation of activation of the respective combustion units is controlled by tightening of at least one respective grappling line.

* * * * *